US006716258B2

(12) United States Patent
Yeh

(10) Patent No.: US 6,716,258 B2
(45) Date of Patent: Apr. 6, 2004

(54) FUEL COMPOSITION

(75) Inventor: Lisa I-Ching Yeh, Marlton, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 128 days.

(21) Appl. No.: 09/732,446

(22) Filed: Dec. 7, 2000

(65) Prior Publication Data

US 2002/0108298 A1 Aug. 15, 2002

Related U.S. Application Data

(60) Provisional application No. 60/172,913, filed on Dec. 21, 1999.

(51) Int. Cl.[7] ..... C10L 1/18

(52) U.S. Cl. ..... 44/388; 44/402; 44/447; 585/14

(58) Field of Search ..... 44/386, 388, 402, 44/445, 446, 447, 451, 452, 449; 585/14

(56) References Cited

U.S. PATENT DOCUMENTS

| | | | | |
|---|---|---|---|---|
| 4,207,078 A | * | 6/1980 | Sweeney et al. | |
| 4,378,973 A | | 4/1983 | Sweeney | 44/56 |
| 4,632,675 A | | 12/1986 | Davies et al. | 44/72 |
| 5,004,478 A | | 4/1991 | Vogel et al. | 44/398 |
| 5,308,365 A | | 5/1994 | Kesling, Jr. et al. | 44/447 |
| 5,324,335 A | | 6/1994 | Benham et al. | 44/452 |
| 5,425,790 A | | 6/1995 | Liotta, Jr. et al. | 44/443 |
| 5,645,613 A | | 7/1997 | Benham et al. | 44/452 |
| 5,689,031 A | * | 11/1997 | Berlowitz et al. | 585/734 |
| 5,720,784 A | | 2/1998 | Killick et al. | 44/451 |
| 5,993,498 A | * | 11/1999 | Vrahopoulou et al. | 44/388 |
| 6,017,372 A | * | 1/2000 | Berlowitz et al. | 44/451 |
| 6,039,772 A | | 3/2000 | Orr | 44/359 |
| 6,447,557 B1 | * | 9/2002 | Yeh et al. | 44/437 |
| 6,447,558 B1 | * | 9/2002 | Yeh et al. | 44/437 |
| 6,468,319 B1 | * | 10/2002 | Yeh et al. | 44/388 |

FOREIGN PATENT DOCUMENTS

| | | | |
|---|---|---|---|
| EP | 0115382 | 8/1984 | C10G/27/12 |
| EP | 0376453 | 7/1990 | C07C/27/16 |
| EP | 0905217 | 3/1999 | C10L/1/02 |
| WO | WO92/20761 | 11/1992 | C10L/1/02 |
| WO | WO93/24593 | 12/1993 | C10L/1/18 |
| WO | WO96/23855 | 8/1996 | C10L/1/14 |
| WO | WO98/05740 | 2/1998 | C10L/1/08 |
| WO | WO98/34998 | 8/1998 | C10L/1/08 |
| WO | WO98/35000 | 8/1998 | C10L/1/18 |
| WO | WO99/21943 | 5/1999 | C10L/1/18 |

OTHER PUBLICATIONS

"New Findings on Combustion Behavior of Oxygenated Synthetic Diesel Fuels", C. Beatrice et al, Combustion Science and Technology, 1998, vol. 137, pp. 31–50.

"The Effect of Oxygenated Fuels on Emissions from a Modern Heavy–Duty Diesel Engine", F. Liotta, Jr. et al, SAE 932734 (Oct. 18–21, 1993).

"Improvement of Diesel Combustion and Emissions with Addition of Various Oxygenated Agents to Diesel Fuels", N. Miyamoto et al, SAE 962115 (Oct. 14–17, 1996).

"The Effects of Fuel Properties and Oxygenates on Diesel Exhaust Emissions", K. Tsurutani et al, SAE 952349 (Oct. 16–19, 1995).

"Effects of Oxygenated Fuel and Cetane Improver on Exhaust Emission From Heavy–Duty DI Diesel Engines", Y. Akasaka et al, SAE 942023 (Oct. 17–20, 1994).

* cited by examiner

*Primary Examiner*—Margaret B. Medley
(74) *Attorney, Agent, or Firm*—Paul E. Purwin

(57) ABSTRACT

This invention relates to a diesel fuel composition comprising a major amount of a base fuel and a relatively minor amount of at least one chemical component other than that generated in a refinery process stream which component is miscible with the base fuel in such proportions that the $T_{30}$ temperature of the resultant composition is in the range from 205–240° C. The control of the $T_{30}$ temperature within the specified range by blending with the minor component results in a significant reduction in particulate emissions.

15 Claims, No Drawings

FUEL COMPOSITION

CROSS REFERENCE TO RELATED APPLICATION

This application claims the benefit of U.S. provisional application 60/172,913 Dec. 21, 1999.

This invention relates to fuel compositions which have been blended with other components which may or may not be hydrocarbons in such a manner that the resultant blend gives rise to reduced particulate emissions from the exhausts of vehicles powered by combustion of such fuels.

Fuels such as diesels are of particular interest and are used rather widely in automotive transport and for providing power for heavy duty equipment due to their high fuel economy. However, one of the problems when such fuels are burned in internal combustion engines is the pollutants in the exhaust gases that are emitted into the environment. For instance, some of the most common pollutants in diesel exhausts are nitric oxide and nitrogen dioxide (hereafter abbreviated as "$NO_x$"), hydrocarbons and sulphur dioxide, and to a lesser extent carbon monoxide. In addition, diesel powered engines also generate a significant amount of particulate emission which include inter alia soot, adsorbed hydrocarbons and sulphates, which are usually formed due to the incomplete combustion of the fuel and are hence the cause of dense black smoke emitted by such engines through the exhaust. The oxides of sulphur have recently been reduced considerably by refining the fuel, e.g., by hydrodesulphurization thereby reducing the sulphur levels in the fuel itself and hence in the exhaust emissions. The presence of particulate matter in such exhaust emissions has been a cause for concern. It is known that the cause of the particulate matter emission is incomplete combustion of the fuel and to this end attempts have been made to introduce into the fuel organic compounds which have oxygen value therein (hereafter referred to as "oxygenates") to facilitate combustion. Oxygenates are known to facilitate the combustion of fuel to reduce the particulate matter and they are also ashless. However, high treat rates are required which means that these cannot be classed simply as minor additives but these become significant components of the fuel composition. Whilst the oxygenates and other components used hitherto in fuels have primarily focussed on the oxygen values and their effect of combustion of fuel, it has hitherto been unrecognized that the performance, especially in respect of reduced particulate emission, can be significantly improved by controlling the volatility of the front to mid-range components in the fuel. In other words, by depressing the temperature range within which the front to mid-range components distil, the particulate emissions from a given fuel composition can be significantly reduced.

It has now been found that this depression of the temperature range within which the front to mid-range components in the fuel are found can be achieved by blending the fuel with suitable materials which can be oxygenates or other hydrocarbon components.

Accordingly, an embodiment of the present invention is a diesel fuel composition comprising a major amount of a base fuel and a relatively minor amount of at least one chemical component other than that generated in a refinery process stream which component is miscible with the base fuel in such proportions that the $T_{30}$ temperature of the resultant composition is in the range from 203–250° C.

By "$T_{30}$ temperature" as used herein and throughout the specifications is meant the temperature by which 30% by volume of the fuel has distilled and is measured using the ASTM D86-95 test method.

By "a chemical component other than that generated in a refinery process stream" is meant a component which is not the direct product of a refining process but may be a product from a chemical plant associated with a refinery. Thus blends of fractions of a refining process are not contemplated as a "chemical component" under the present invention.

The fuels that may be used in and benefit by the compositions comprise inter alia distillate fuels, and typically comprise a major amount of diesel fuel, jet fuel, kerosene or mixtures thereof. The diesel fuel used is preferably ashless. The distillate fuel itself may be obtained by conventional refinery distillate methods, or may be synthesized, e.g., by the Fischer-Tropsch method or the like. It is preferable, however, that the olefin content of the base fuel is no more than 10% by weight. The fuel is most preferably a low sulphur diesel fuel with a sulphur content of 500 ppm or less. One such low sulphur base fuel is obtainable from Esso's Refinery at Fawley, UK.

It is also preferable that the diesel fuel compositions are substantially free of C1–C2 alcohols and thus the compositions do not embrace gasohol type compositions which contain significant amounts of ethanol and/or methanol; the present compositions contain no more than adventitious amounts of these alcohols, e.g., not more than 5% by weight of such alcohols, and preferably no C1–C2 alcohols at all.

It is known that the $T_{30}$ temperature of most of the conventional diesel fuels is from about 250–280° C. The feature of an embodiment of the invention is to blend such conventional base fuels with one or more components in such amounts that the $T_{30}$ temperature of the resultant blend is within the range from 203–250° C., suitably from 205–240° C., preferably from 210–235° C.

To bring the $T_{30}$ temperature within the desired range, the base fuel may be blended with a variety of minor chemical components. It is preferable that the minor chemical component blended with the fuel has a boiling point which is below the desired upper limit of the $T_{30}$ temperature of the resultant blend, e.g., below 240° C. if it comprises a single entity or has a $T_{50}$ below 240° C. if it comprises a mixture of components. For instance, the base fuel may be blended with a hydrocarbon fraction from a chemical plant associated with the refinery to achieve this effect. An example of such a hydrocarbon fraction is one or more alkanes, for example a mixture consisting of primarily isodecanes. Alternatively, the minor chemical component in such a fuel may be one or more aliphatic hydroxy compounds selected from alcohols, glycols, triols, polyols and ethers alcohols; full ethers of such hydroxy compounds, partial or full esters of one or more of the hydroxy compounds with aliphatic mono-, di-, tri- or poly-carboxylic acids. The hydroxy compounds may be comprised of primary, secondary or tertiary hydroxy functions and may be straight or branched chain. The hydroxy compounds suitably have 6 to 20 carbon atoms and preferably from 8 to 16 carbon atoms. Specific examples of such hydroxy compounds include the monohydric alcohols selected from one or more of n-hexanol, methyl pentanols, n-octanol, isooctanol, n-nonanol, isononanols, n-decanol, isodecanol, n-undecanol, isoundecanol, n-dodecanol, isododecanol, tridecanol and isotridecanol. Some of these alcohols are commercially available as Exxal®10 and Exxal®12 from Exxon Chemicals. The glycols and polyols suitably have from 2 to 20 carbon atoms and these may be polyether diols or polyols. The ethers referred to above suitably contain from 5 to 20 carbon atoms. The two hydrocarbyl groups attached to the ethereal oxygen atom may be in the form of primary, secondary or tertiary alkyl groups, aryl groups and the two hydrocarbyl groups may be the same or different. Specific examples of such ethers include methyl tertiary butyl ether, ditertiary butyl ether and anisole. The esters may be derived by reacting one or more of the aliphatic carboxylic acids referred to above with the hydroxy compounds referred to above.

The amount of any of the minor chemical components referred to above blended with the base fuel to form the fuel compositions of embodiments of the present invention will depend upon the chemical characteristics of the minor chemical component. For instance, it is most desirable that the boiling point of the minor chemical component is below 240° C. and that it is miscible with the base fuel over a wide range. Thus, if the base fuel is blended with another hydrocarbon fraction, the boiling point and degree of miscibility of this hydrocarbon fraction would be significant in determining the amount blended with the base fuel. Similarly, if an oxygenate is blended with the base fuel, the amount of oxygenate blended would be determined by the miscibility of the oxygenate with the base fuel, the number of oxygen atoms in the oxygenate and the boiling point of the oxygenate. Typically, the amount of the miscible minor chemical component blended with the base fuel is suitably at least 5% by weight of the total composition. Typically, if an oxygenate is used, it is preferably such that it brings the $T_{30}$ temperature of the resultant blend within the range from 205–240° C. Thus, to achieve this composition, the amount of oxygenate added to the composition is suitably greater than 5% by weight of the total composition, and is preferably greater than 7% w/w of the total composition. Typically, the oxygenates are used in an amount in the range from 5 to 60% by weight, preferably from 7 to 40% by weight of the total composition. Within these ranges, it would be possible to use a relatively low amount of a specific oxygenate if said oxygenate has a relatively high oxygen content and conversely, one may have to use a higher amount of a particular oxygenate if it is relatively low in oxygen content so that the blended composition has at least 0.5% w/w of oxygen, suitably at least 1.0% by weight of oxygen and preferably at least 2% by weight of oxygen.

Thus, according to a further embodiment, the present invention is a method of reducing particulate emissions upon combustion of a diesel fuel composition, said method comprising blending the base diesel fuel with a minor amount of a miscible chemical component other than that generated in a refinery process stream in sufficient amount such that the $T_{30}$ temperature of the resultant composition is within the range from 203–250° C.

The blending may be carried out by conventional means of intimate mixing of the base fuel with the minor chemical component. The diesel fuel compositions having a $T_{30}$ temperature within the range from 203–250° C., preferably from 205–240° C. of the present invention are capable of reducing particulate emissions both at high and low loads.

The diesel fuel compositions the present invention and their performance are further illustrated with reference to the following Examples and Comparative Tests:

EXAMPLES

GENERAL

The reference fuel used as base stock in the tests conducted below was that from Esso's Fawley refinery (hereafter referred to as "LSADO") and had the following characteristics:

| | |
|---|---|
| Density | 851 kg/m$^3$ |
| $KV_{20}$ (cSt) | 5.03 |
| Sulphur content | 400 ppm |
| $T_{95}$ | 343° C. |

The dimensions of the engine used for testing are shown in Table 1 below:

TABLE 1

| Engine | Cat 1Y540 |
|---|---|
| Bore (mm) | 137.2 |
| Stroke (mm) | 165.1 |
| Swept Volume (liters) | 2.43 |
| Compression ratio | 13.37:1 |
| Aspiration | Simulated turbo-charged |

In the Tables the following abbreviations have been used:

| | |
|---|---|
| LSADO | Low sulphur (≦500 ppm automotive diesel oil (ex Esso's Fawley refinery) as base stock. |
| ULSADO | Ultra low sulphur (≦50 ppm S) automotive diesel oil (ex Esso's Fawley refinery) |
| ADO | Automotive diesel oil |
| Exxal ® 10 | A mixture of decanols including isodecanol (CAS No. 93821-11-5 & EINECS No 2986966, ex Exxon Chemicals) |
| Exxal ® 12 | A mixture of dodecanols including isododecanol (CAS No. 90604-37-8 & EINECS No 2923909, ex Exxon Chemicals) |
| Iso-nonanol | Primarily 3,5,5-trimethyl hexanol |
| Isopar ® M | A mixture of isodecanes (ex Exxon Chemicals) |
| Technical pentaerythritol | contains a mixture of mono- (approx. 88%), di- (approx. 10–12%) and the remainder tri-pentaerythritols (ex Hoechst Celanese) |
| PM | Particulate Matter |

Example 1

Emissions testing was carried out in a single cylinder version of the Caterpillar 3406 heavy duty engine. A full dilution tunnel with primary dilution ratios of about 10:1 at high load and 15:1 at low load was used for particulate collection and analysis. Dynamic injection timing was kept constant for the range of fuels tested and the engine was supercharged using two external Roots pumps.

Nine fuels were tested. Seven of the fuels were comprised of an oxygenated component and base LSADO. Another fuel was comprised of Isopar® M blended into LSADO. Their emissions performance was compared against LSADO which served as the reference fuel.

Two steady state conditions were chosen for testing, both at 1500 rpm. The high load condition was 220 Nm and the low load condition was 60 Nm. Each fuel was tested over five or six different days in a randomized fuel test sequence for each day. Particulates were collected on two filter papers for 10 minutes each and these results were averaged to generate the data point for each fuel for each day.

The resultant particulate results are listed in the table below for each fuel averaged over the 5–6 days of testing in g/kWh. At both high and low load a correlation with fuel $T_{30}$ temperature was seen although the correlation between fuel $T_{30}$ and particulate mass was stronger at low load.

TABLE 1

| Test Fuel | $T_{30}$ (° C.) | High Load PM (g/kWh) | Low Load PM (g/kWh) |
|---|---|---|---|
| LSADO | 262 | 0.179 | 0.400 |
| Trimethoxymethane + LSADO | 258 | 0.142 | 0.389 |
| Diethylene glycol dimethyl ether* + LSADO | 255 | 0.133 | 0.378 |
| Tech. Polyol Ester with branched acids # + LSADO | 267 | 0.150 | 0.396 |
| Tech. Polyol Ester with linear acids** + LSADO | 268 | 0.146 | 0.391 |
| Exxal ® 10 + LSADO | 234 | 0.111 | 0.337 |
| Isopar ® M + LSADO | 249 | 0.156 | 0.365 |
| Anisole + LSADO | 243 | 0.135 | 0.346 |
| Methyl t-butyl ether + LSADO | 253 | 0.144 | 0.378 |

*Also known as diglyme and 2-methoxyethyl ether.

Is an ester of technical pentaerythritol with a mixture of Cekanoic ® 8 and 9 carboxylic acids (ex Exxon Chemicals) derived from technical grade pentaerythritol (5 moles), and the Cekanoic ® 8 acid (2.5 moles) and 3,5, 5-trimethylhexanoic acid (12.5 moles) to form a high hydroxyl polyol ester having a viscosity of 177.8 cSt at 40° C. and 13.37 cSt at 100° C., and having a hydroxyl No. of 123 according to the standard method described in American Oil Chemists Society as A O C S, Cd 13–16.

**Is an ester of technical grade pentaerythritol with linear acids derived from coconut oil comprising approx. 55% w/w C8 monocarboxylic acids, approximately 40% w/w C10 monocarboxylic acids and the remainder being C6 and C12 acids (available commercially from Procter & Gamble). These are reacted in a ratio of about 4 moles of linear acid per mole of technical pentaerythritol to the desired conversion level of 70–95% of the alcohol groups converted to ester functions.

Example 2

Emissions testing was carried out in a single cylinder version of the Caterpillar 3406 heavy duty engine. A full dilution tunnel with a primary dilution ratio of about 15:1 at low load was used for particulate collection and analysis. Dynamic injection timing was kept constant for the range of fuels tested and the engine was supercharged using two external Roots pumps.

Twelve fuels were tested. Seven different base fuels were tested as well as five oxygenated fuels blended into two different base fuels. The base fuels were obtained from Esso's Fawley refinery, UK unless otherwise indicated.

One steady state condition was chosen for testing at 1500 rpm and 60 Nm. Each fuel was tested over six different days in a randomized fuel test sequence for each day. Particulates were collected on two filter papers for 10 minutes each and these results were averaged to generate the data point for each fuel for each day.

The resultant particulate results are listed in the table below for each fuel averaged over the six days of testing in g/kWh. A strong correlation between particulate mass and fuel $T_{30}$ temperature was seen.

TABLE 2

| Fuel | $T_{30}$ | PM, g/kWh |
|---|---|---|
| Ingolstadt LSADO | 237 | 0.421 |
| Ingolstadt GO1* | 203 | 0.419 |
| OC-6# | 251 | 0.450 |
| Swiss LS ADO | 222 | 0.384 |
| Exxal ®-10 + LSADO | 234 | 0.393 |
| Iso-nonanol + LSADO | 224 | 0.385 |
| Exxal ®-12 + LSADO | 246 | 0.389 |
| ULSADO | 239 | 0.371 |
| Exxal ®-10 + ULSADO | 223 | 0.339 |
| Iso-nonanol + ULSADO | 210 | 0.329 |
| LSADO | 262 | 0.474 |

TABLE 2-continued

| Fuel | $T_{30}$ | PM, g/kWh |
|---|---|---|
| French ADO | 272 | 0.512 |

*Ingolstadt GO1 is a gas oil obtained from Esso's Ingolstadt refinery

#OC-6 is a research fuel made from a blend of refinery streams

Characteristics of various base fuels tested

| | Ingolstadt LSADO | Ingolstadt GO1 | OC-6 | Swiss LSADO | Fawley ULSADO | French ADO |
|---|---|---|---|---|---|---|
| Density | 838 | 825 | 837 | 825 | 825 | 856 |
| $KV_{20}$ (cSt) | 3.91 | 2.62 | 5.04 | 3.12 | 3.41 | 5.58 |
| Sulfur content | 0.02 | 0.05 | 0.05 | 0.03 | 0.003 | 0.05 |
| $T_{95}$ (°C.) | 340 | 355 | 353 | 318 | 314 | 350 |

What is claimed is:

1. A diesel fuel composition comprising a major amount of a base distillate fuel containing no more than 10 wt % olefins, and having a $T_{30}$ temperature in the range of about 250 to 280° C. and an additive for reducing particulate emissions in proportions sufficient to provide the diesel fuel composition with a $T_{30}$ in the range of 203 to 250° C., the additive being at least one chemical component other than that generated in a refinery process stream and which component is miscible with the base distillate fuel in the aforesaid proportions and wherein the additive is selected from the group consisting of (a) alkane or alkanes, (b) ester or esters, (c) ether or ethers, and mixtures of (b) and (c).

2. The composition according to claim 1 wherein the $T_{30}$ temperature of the composition resulting from the mixture of the base distillate fuel with the additive is in the range from 205–240° C.

3. The diesel fuel composition of claim 1 wherein the diesel fuel composition is substantially free of $C_1$–$C_2$ alcohols and wherein when the additive is (b) or (c) or a mixture of (b) and (c) the additive is present in an amount sufficient to provide the fuel composition with at least 0.5 wt% oxygen.

4. The composition according to claim 1 wherein the base fuel has a sulfur content of 500 ppm or less.

5. A distillate fuel composition comprising a major amount of a base distillate fuel wherein said base distillate fuel has an olefins content of no more than 10 wt %, a sulfur content of less than 500 ppm and $T_{30}$ temperture from about 250° C. to 280° C. and a minor amount of an additive which is at least one chemical component other than that generated in a refinery process stream and which component is miscible with the base distillate fuel, said additive being present in an amount sufficient to provide the distillate fuel composition with a $T_{30}$ in the range of from 205 to 240° C., said additive being selected from the group consisting of (a) alkane or alkanes, (b) ether or ethers, (c) ester or esters, and mixtures of (b) and (c), and when said additive is (b) or (c) or a mixture of (b) and (c) said additive is present in an amount sufficient to provide the fuel composition with at least 0.5 wt % oxygen.

6. The composition according to claim 2 wherein the $T_{30}$ temperature of the composition is brought within the desired range of 205–240° C. by blending the base distillate fuel with an additive which if a single chemical component has a boiling point below 240° C., or if comprising a mixture of chemical component has a $T_{50}$ below 240° C.

7. The composition according to claim 1 wherein the additive blended with the base distillate fuel is a mixture of alkanes consisting primarily of isodecanes.

8. The distillate fuel composition of claim 5 wherein when the additive is (b) or (c) or a mixture of (b) and (c) the additive is present in an amount sufficient to provide the fuel composition with at least 1.0 wt % oxygen.

9. The distillate fuel composition of claim 5 wherein when the additive is (b) or (c) or a mixture of (b) and (c) the additive is present in an amount sufficient to provide the fuel composition with at least 2.0 wt % oxygen.

10. A method for reducing particulate emmissions upon combustion of a diesel fuel composition, said method comprising blending a base distillate fuel containing not more than 10 wt % olefins and having a $T_{30}$ temperture in the range of about 250 to 280° C. with relatively minor amount of miscible additive in an amount such that the $T_{30}$ temperture of the resultant composition is within the range of 230–250° C. and wherein the additive is selected from the group consisting of (a) alkane or alkanes, (b) ester or esters, (c) ether or ethers, and mixtures of (b) and (c).

11. The method of claim 10 wherein the diesel fuel composition is substantially free of $C_1$–$C_2$ alcohol and when the additive is (b) or (c) or a mixture of (b) and (c) the additive is present in an amount sufficient to provide the fuel composition with at least 0.5 wt % oxygen.

12. The composition according to claim 1 wherein the additive is an aliphatic ether and has from 5 to 20 carbon atoms.

13. The composition according to claim 12 wherein the ether is selected from methyl tertiary butyl ether and ditertiary butyl ether.

14. The composition according to claim 1 wherein the additive is an ester of a C4 to C20 aliphatic carboxylic acid.

15. The composition according to claim 12, 13, or 14 wherein the amount of the additive blended with the base distillate fuel is at least 5% by weight of the total composition.

* * * * *